US006146184A

United States Patent [19]

Wilson et al.

[11] Patent Number: 6,146,184

[45] Date of Patent: Nov. 14, 2000

[54] CIRCUIT BOARD MOUNTED CONNECTOR ASSEMBLY AND METHOD OF FABRICATING SAME

[75] Inventors: Bill B. Wilson, Montgomery; Paul B. Cecil, Waukegan, both of Ill.

[73] Assignee: Molex Incorporated, Lisle, Ill.

[21] Appl. No.: 09/337,426

[22] Filed: Jun. 21, 1999

[51] Int. Cl.[7] ..... H01R 13/64

[52] U.S. Cl. ..... 439/374; 439/248

[58] Field of Search ..... 439/248, 247, 439/78, 58, 374, 557, 558, 565, 567

[56] References Cited

U.S. PATENT DOCUMENTS

| | | | |
|---|---|---|---|
| 4,269,467 | 5/1981 | Hughes | 339/126 R |
| 4,761,144 | 8/1988 | Hunt, III et al. | 439/545 |
| 4,824,387 | 4/1989 | deJong et al. | 439/248 |
| 5,002,497 | 3/1991 | Plocek et al. | 439/248 |
| 5,890,922 | 4/1999 | Buchter et al. | 439/284 |
| 6,007,375 | 12/1999 | Mackowiak et al. | 439/657 |

*Primary Examiner*—Brian Sircus
*Assistant Examiner*—Chaudrika Prasad

[57] ABSTRACT

A circuit board mounted electrical connector assembly is adapted for connection to a complementary mating connector through an opening in the circuit board. A connector housing is provided with a plurality of terminals. The housing is mounted on the circuit board. Portions of the terminals are soldered to appropriate circuit traces on the circuit board. A guide member is mounted on the housing after the soldering process so that the guide member does not interfere with the soldering process. However, after soldering, the guide member facilitates guiding the mating connector into connecting position.

12 Claims, 9 Drawing Sheets

CIRCUIT BOARD MOUNTED CONNECTOR ASSEMBLY AND METHOD OF FABRICATING SAME

FIELD OF THE INVENTION

This invention generally relates to the art of electrical connectors and, particularly, to a connector mounted on a circuit board and mateable with a complementary mating connector through an opening in the board along with a method of fabricating the board mounted connector.

BACKGROUND OF THE INVENTION

Electrical connector assemblies are used in a wide variety of applications wherein a connector is mounted on a chassis such as a panel, a circuit board or the like. The connector mates with a complementary mating connector mounted on an opposing panel or through an opening in the opposing. panel. Problems in some such applications include insufficient spacing between the circuit board and the opposing panel to allow the connector to be mounted on the side of the circuit board facing the opposing panel. A solution to insufficient spacing between the board and the opposing panel is to mount the connector about an opening in the board on the side of the board facing away from the opposing panel as disclosed herein.

In some such applications, the connector must be mated with the mating connector under "blind" mating conditions, and guide means are provided on the connector for guiding the mating connector into proper connecting or mated position. For instance, the circuit board mounted connector may be in the form of a receptacle connector and have a peripheral funnelshaped guide means about the periphery of the receptacle for guiding a mating plug connector into the receptacle through the opening in the panel.

Problems have been encountered in providing circuit board mounted connectors with appropriate guide means for the mating connector. With circuit board mounted connectors, the connector includes terminals which are connected, as by soldering, to appropriate circuit traces on the side of the circuit board facing the opposing panel. The guide means on the connector for guiding the mating connector can interfere with the soldering process for the terminals of the circuit board mounted connector. In other words, if the connectors are mated through an opening in the circuit board, the terminals must be soldered to circuit traces on the board outside the opening. If the guide means flares outwardly of the opening, the guide means either will interfere with the soldering process or the terminals must be soldered at points unduly spaced outwardly of the connector to avoid interference by the guide means. The present invention is directed to solving these problems by a unique connector assembly wherein the guide means is mounted to the connector after the soldering process.

SUMMARY OF THE INVENTION

An object, therefore, of the invention is to provide a new and improved method of fabricating a circuit board mounted electrical connector assembly which is adapted for connection to a complementary mating connector through an opening in the circuit board.

Another object of the invention is to provide a new and improved electrical connector assembly fabricated according to the method of the invention.

In the exemplary embodiment of the invention, a connector housing is provided with a plurality of terminals. The housing is mounted on the circuit board. Portions of the terminals are soldered to appropriate circuit traces on the circuit board. A guide member is mounted on the housing after the soldering step so that the guide member does not interfere with the soldering process, but the guide member, thereafter, facilitates guiding the mating connector into connecting position.

As disclosed herein, the housing is mounted to one side of the circuit board about an opening in the board, and the terminals are soldered to the circuit traces on an opposite side of the board. The guide member is mounted on the housing through the opening in the circuit board from the opposite side of the board.

A unique feature of the invention is the provision of latching means in the form of at least one flexible latch arm for latching the connector housing in the opening in the circuit board. When the guide member is mounted on the housing, the guide member abuts the flexible latch arm and prevents the latch arm from moving out of latching engagement with the board.

The connector housing includes a mating receptacle aligned with the opening in the circuit board for receiving a plug portion of the complementary mating connector. The terminals are generally U-shaped and include contact pin portions projecting into the receptacle and terminating pin portions projecting through the board. Resilient means in the form of at least one integrally molded leaf spring is provided at the bottom of the receptacle for engagement by the plug portion of the mating connector to absorb mating forces interacting between the connectors.

The guide member and the housing include opposing shoulders for sandwiching the circuit board therebetween. Complementary interengaging latch means are provided between the guide member and the housing to hold the guide member and housing in latched engagement sandwiching the circuit board therebetween.

In an alternative embodiment of the invention, a dielectric housing has side walls extending upwardly from a base for mounting about an opening in a circuit board. A plurality of terminals mounted on the housing including contact portions inside the housing extend upwardly from the base for engaging appropriate terminals of a mating connector through the opening in the circuit board. The terminals also include terminating portions outside of the housing extending upwardly for termination to appropriate circuit traces on the circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
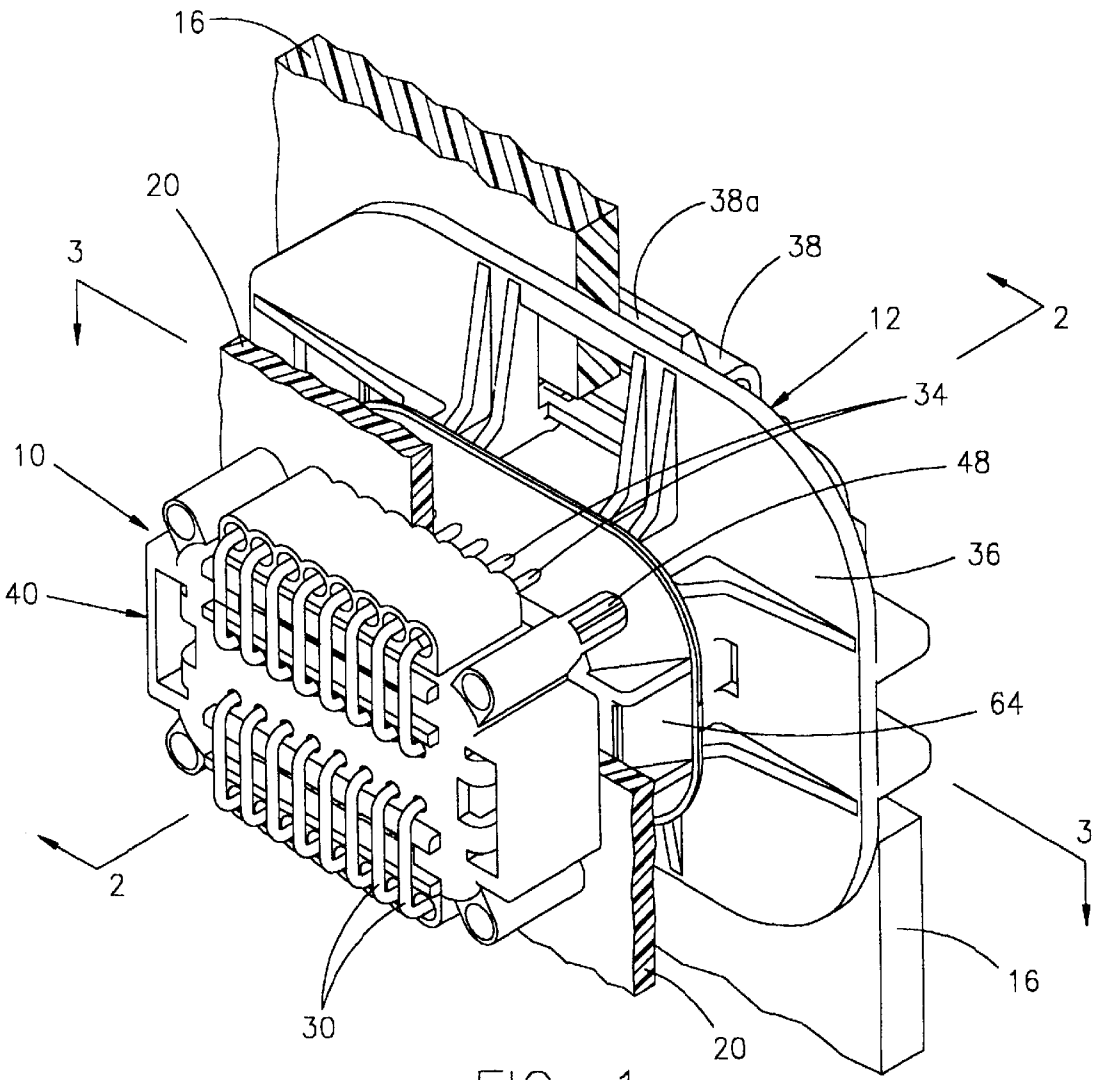
FIG. 1 is a perspective view of a pair of mating connectors including the circuit board mounted connector of the invention.
Figure 2:
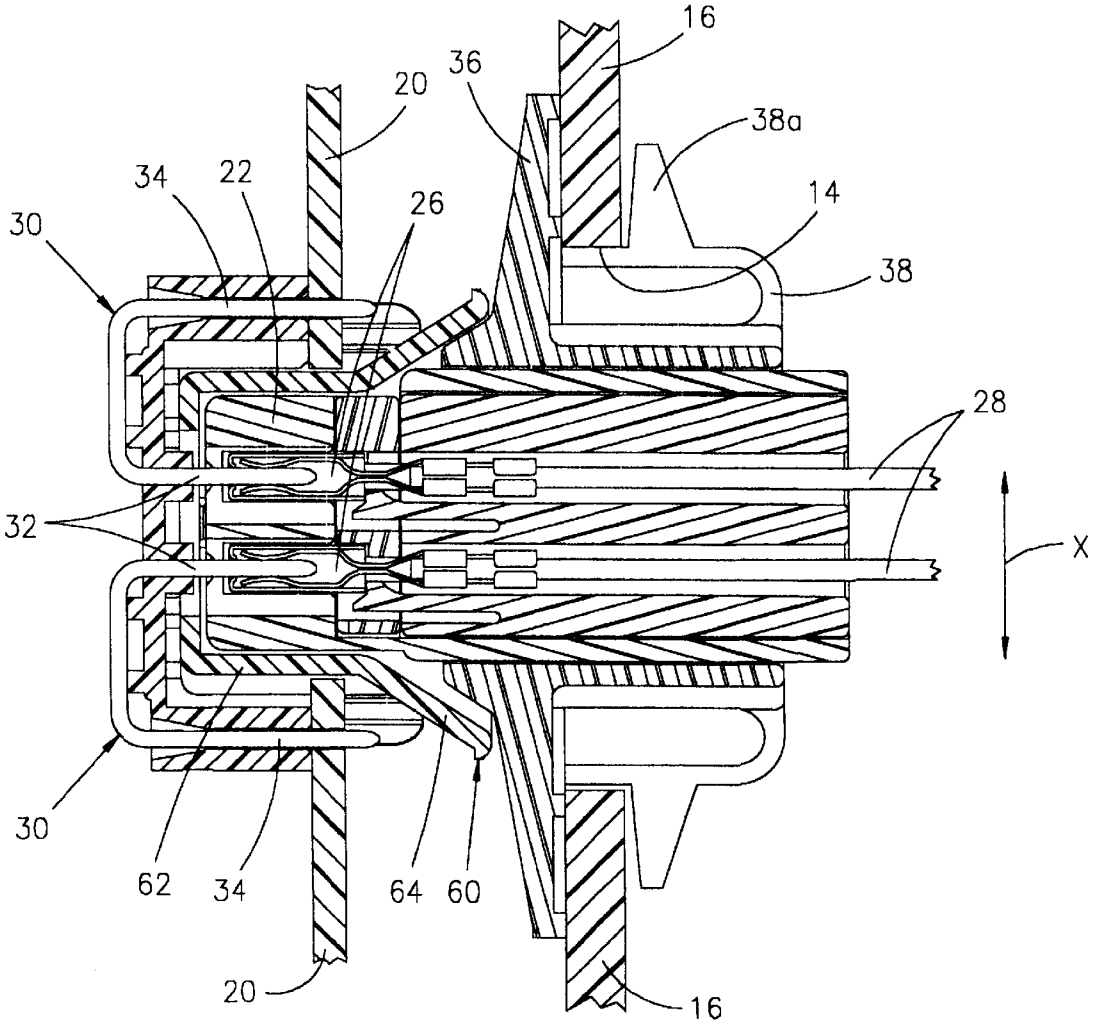
FIG. 2 is a vertical section taken generally along line 2—2 of FIG. 1.
Figure 3:
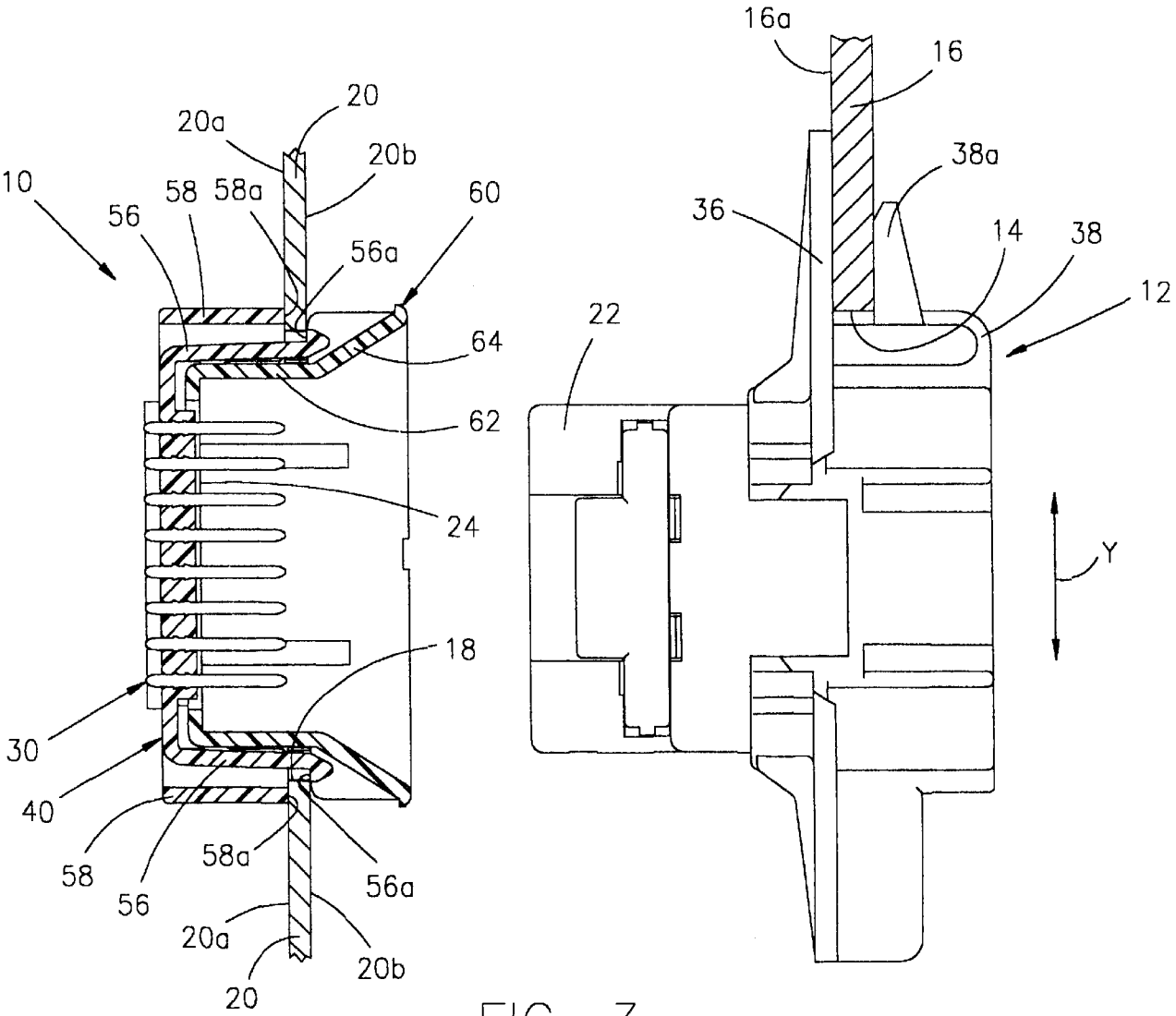
FIG. 3 is a horizontal section taken generally along line 3—3 of FIG. 1, but with the two connectors unmated.

Referring to the drawings in greater detail, and first to FIGS. 1–3, the invention is embodied in a circuit board mounted electrical connector assembly, generally designated 10, which is adapted for connection to a complementary mating connector, generally designated 12. Mating connector 12 is adapted for mounting in a cut-out 14 in a panel or chassis 16 (FIGS. 2 and 3), and board mounted connector 10 is adapted for mounting through an opening 18 in a circuit board 20 (FIG. 3).

The mating or panel mounted connector 12 includes a plug portion 22 (FIGS. 2 and 3) for insertion into a receptacle 24 (FIG. 3) of circuit board mounted connector 10. Mating connector 12 mounts a plurality of female terminals 26 (FIG. 2) each terminated to an electrical wire 28. Board mounted connector 10 mounts a plurality of terminals, generally designated 30, which include contact pin portions 32 insertable into female terminals 26. Terminals 30 are generally U-shaped and include lateral portions 33 connecting contact pin portions 32 to outside terminating pin portions 34 which project through circuit board 20 for solder connection to appropriate circuit traces on the board.

Mating connector 12 includes a peripheral flange 36 for abutting against one side 16*a* of panel 16. A flexible cantilevered arm 38 is provided on each of three sides of the mating connector to allow the connector to be mounted in cutout 14 in the panel. An abutment flange 38*a* projects radially outwardly from each cantilevered arm 38. When the mating connector is mounted in the cut-out in the panel, the panel is sandwiched between abutment flanges 38*a* and peripheral flange 36 as best seen in FIGS. 2 and 3. Flexible arms 38 provide relative floating action between the mating connector and the panel in "X" and "Y" directions (i.e., parallel to the panel).

Figure 4:
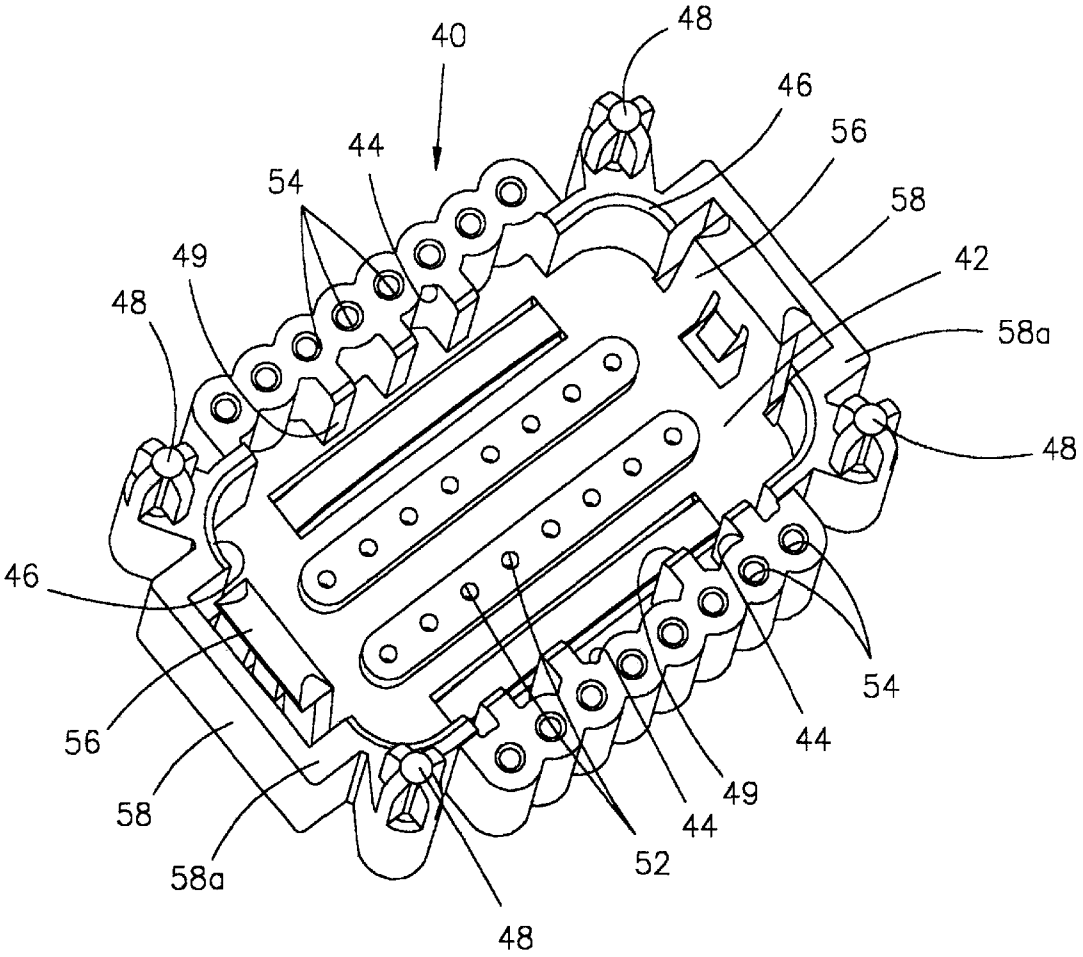
FIG. 4 is a top perspective view of the housing of the circuit board mounted connector, with the guide member removed.
Figure 5:
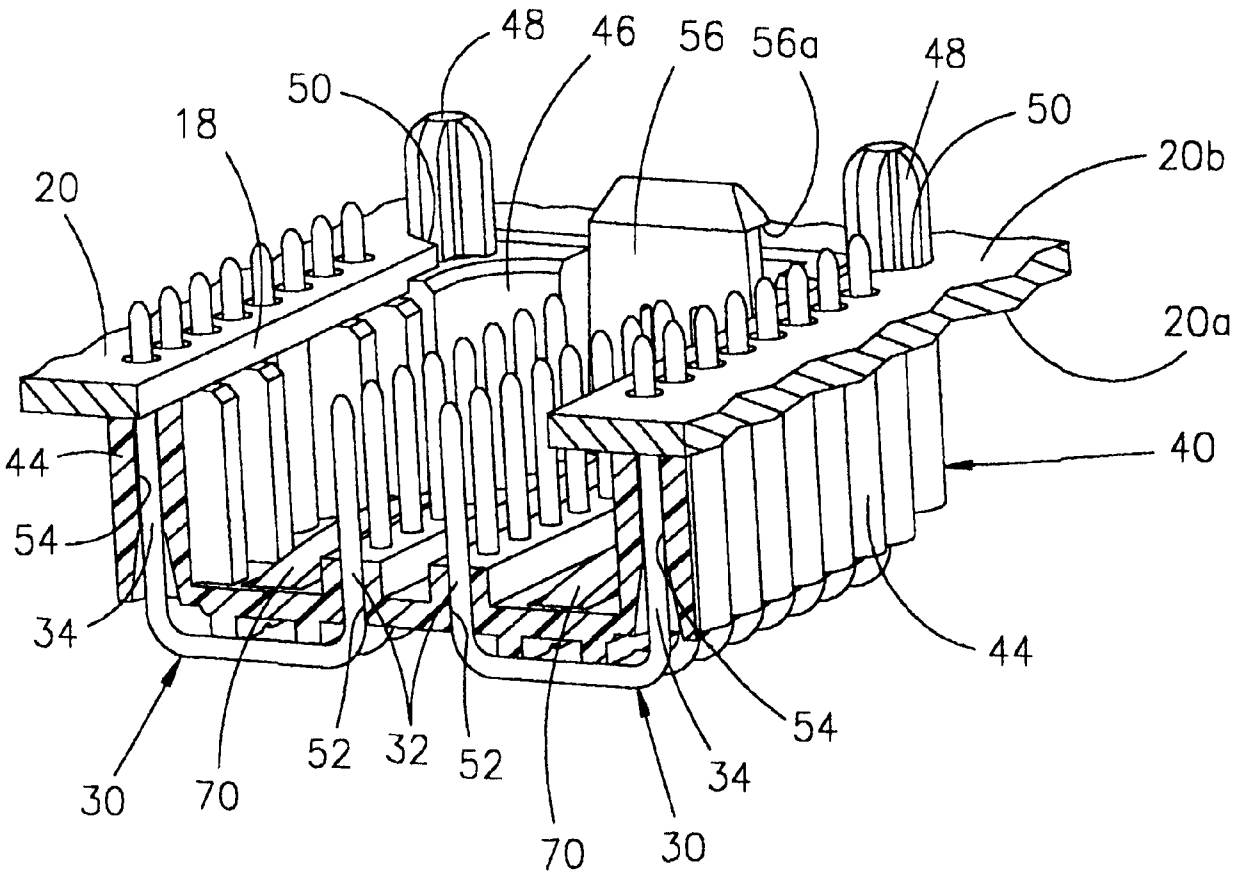
FIG. 5 is a sectioned perspective view of the connector mounted to the circuit board, with the guide member removed.

Referring to FIGS. 4 and 5 in conjunction with FIGS. 1–3, circuit board mounted connector 10 includes a one-piece housing, generally designated 40, which is unitarily molded of dielectric material such as plastic or the like. The housing has a base or bottom wall 42, side walls 44 and end walls 46 which define a receptacle for receiving plug portion 22 of mating connector 12 as well as a funnel-shaped guide member described hereinafter. The receptacle is aligned with opening 18 in circuit board 20 as seen in FIG. 5. The housing includes four rigid mounting posts 48 at the corners thereof for positioning through recesses 50 at the four corners of opening 18 in the board. Passages 52 are provided in bottom wall 42 for receiving contact pin portions 32 of terminals 30 and passages 54 are formed along the outside of side walls 44 for receiving terminating pin portions 34 of terminals 30. Ribs 49 are formed along the inside of side walls 44 in a predetermined array for polarization purposes.

The lateral portions 33 of the terminals 30 extend laterally below the bottom wall 42 of the housing. The contact pin portions 32 extend upwardly parallel to side walls 44 to below top edge 45 of the side walls 44. The terminating pin portions 34 also extend upwardly parallel to side walls 44 to above top edges 45 of the side walls 44. Accordingly, terminating pin portions can protrude through holes 19 in circuit board 20 for electrical connection to a top side 20*b* of the board 20.

Still referring to FIGS. 4 and 5 and particularly in conjunction with FIG. 3, connector housing 40 is provided with means for latching the housing to circuit board 20. In particular, a flexible latch arm 56 is integrally molded with the housing at each end wall 46 thereof. Each latch arm has a latching hook 56*a*. A generally U-shaped shroud portion 58 of the housing surrounds the outside of each flexible latch arm 56. The shroud protects the latch arm and also provides an abutment shoulder 58*a*. When the housing is mounted to circuit board 20 as seen best in FIGS. 3 and 5, the circuit board is sandwiched between abutment shoulders 58*a* of shrouds 58 on one side 20*a* of the board and latching hooks 56*a* of flexible latch arms 56 on an opposite side 20*b* of the circuit board.

With the structural combination of mounting posts 48, latching hooks 56*a* of latch arms 56 and abutment shoulders 58*a* of shrouds 58, connector housing 40 is held rigid with respect to circuit board 20. In other words, mounting posts 48 prevent the housing from moving generally parallel to the circuit board, and latching hooks 56*a* and abutment shoulders 58*a* prevent the housing from moving generally perpendicular to the circuit board.

Figure 6:
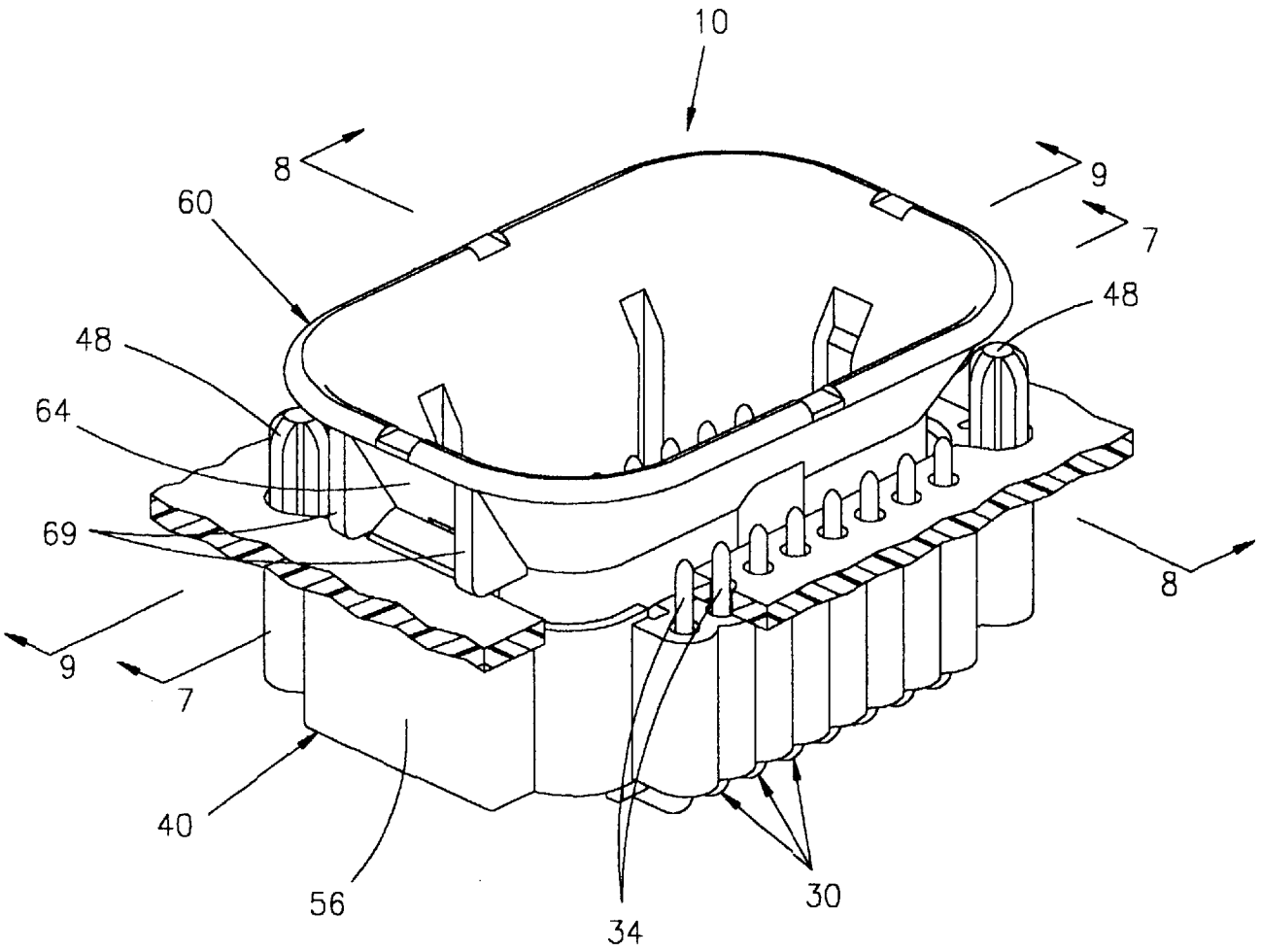
FIG. 6 is a perspective view of the connector, including the guide member, mounted to the circuit board.
Figure 7:
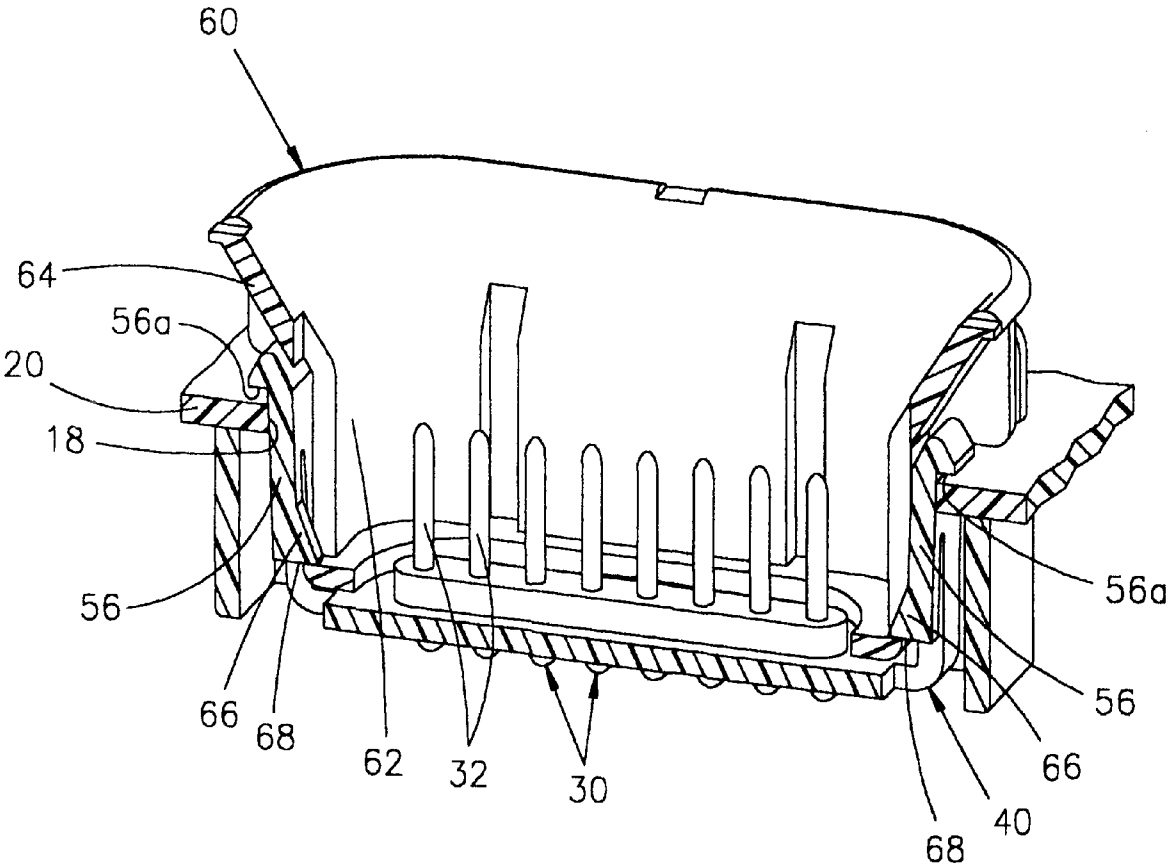
FIG. 7 is a vertical section taken generally along line 7—7 of FIG. 6.

Referring to FIGS. 6–9, circuit board mounted connector 10 is completed by inserting a funnel-shaped guide member, generally designated 60, through opening 18 in circuit board 20 and into the receptacle defined by connector housing 40. This also is seen in FIGS. 2 and 3. The funnel-shaped guide member includes a generally rectangular straight portion 62 (FIGS. 7–9) and an outwardly diverging or flared funnel portion 64. Straight portion 62 is inserted through the opening in the circuit board, and funnel portion 64 provides a guide means for guiding plug portion 22 (FIG. 3) of mating connector 12 into connecting position within board mounted connector 10. As best seen in FIG. 7, the guide member is latched within housing 40 by means of a pair of latch hooks 66 projecting inwardly of flexible latch arms 56 of the housing and into latching engagement with a pair of latch shoulders 68 formed in the guide member.

Guide member 60 performs a dual function of preventing flexible latch arms 56 of housing 40 from becoming unlatched from the circuit board. More particularly, as seen best in FIG. 7, when the guide member is inserted into housing 40, the ends of straight portion 62 of the guide member engage or back-up against the insides of flexible latch arms 56. This prevents the latch arms from moving inwardly and prevents latching hooks 56*a* of the latch arms from disengaging the circuit board.

Guide member 60 also has a plurality of ribs 69 beneath funnel portion 64 thereof. Circuit board 20 is sandwiched between ribs 69 and abutment shoulders 58*a* of housing 40.

Figure 8:
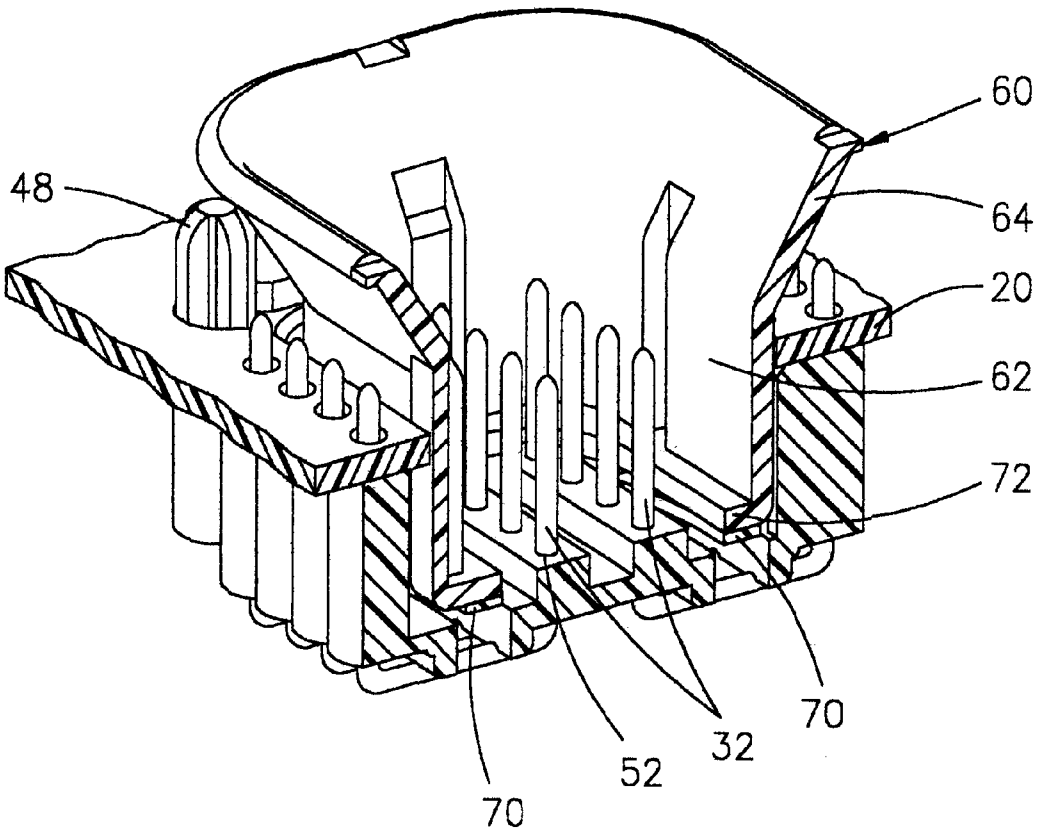
FIG. 8 is a vertical section taken generally along line 8—8 of FIG. 6, with the circuit board removed.
Figure 9:
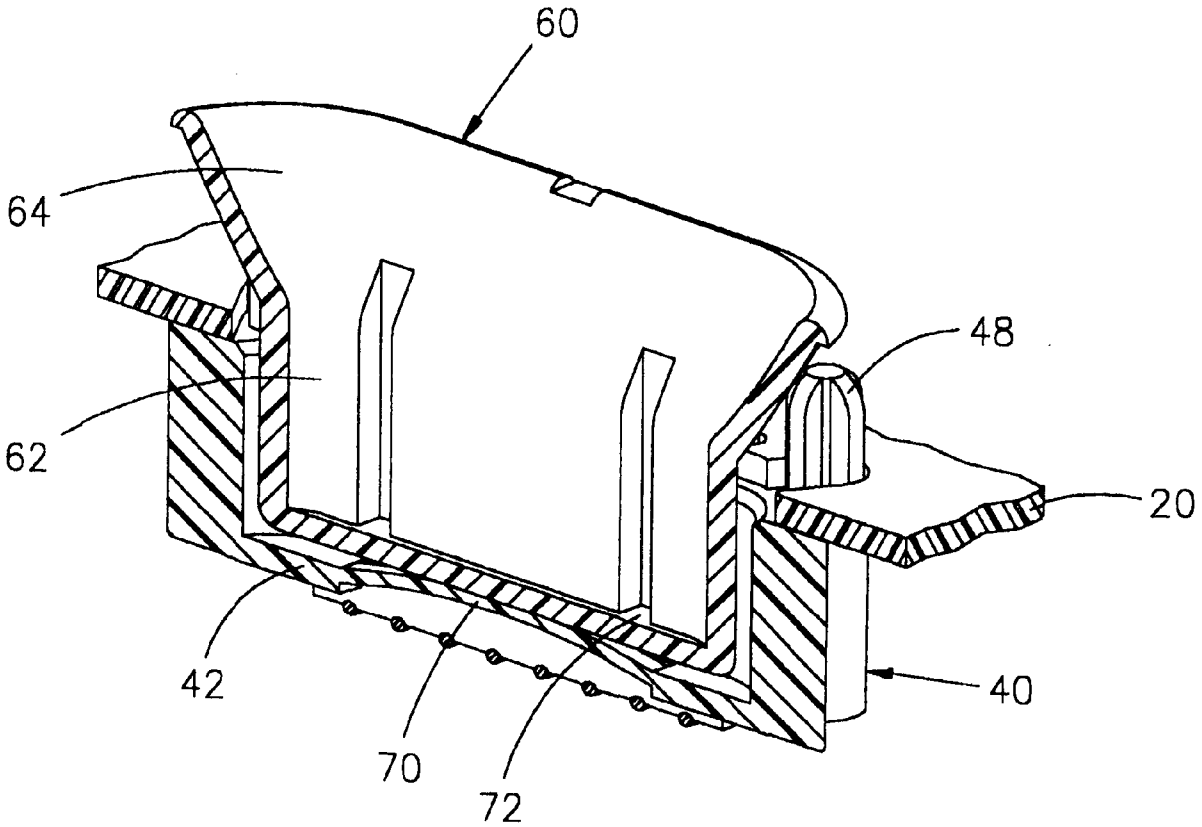
FIG. 9 is a vertical section taken generally along line 9—9 of FIG. 6, with the circuit board removed.

FIGS. 8 and 9 show a feature of the invention which absorbs mating forces interacting between the panel mounted or mating connector 12 and circuit board mounted connector 10. More particularly, a pair of upwardly arched leaf springs 70 are molded integrally with bottom wall 42 of connector housing 40. These leaf springs engage the underside of a pair of bottom ledges 72 of the funnel-shaped guide member 60. When plug portion 22 (FIG. 3) of mating connector 12 is inserted into the guide member as shown in FIG. 2, the guide member is backed by leaf springs 70 and, thereby, absorb mating forces interacting between the two connectors.

In the fabrication of board mounted connector 10, housing 40 is provided as shown in FIG. 4. Terminals 30 then are mounted in the housing as best seen in FIGS. 2 and 5. The housing and terminals then are mounted to circuit board 20 from a first side 20*a* thereof as seen in FIG. 5. Terminating pin portions 34 protrude through holes 19 through to the opposite or second side 20*b* of circuit board 20 and then are soldered to appropriate circuit traces (not shown) on the opposite or second side 20*b* of the circuit board as mounting posts 48 and latch arms 56 rigidly hold the housing to the circuit board. Guide member 60 then is mounted to the housing after the soldering process. The guide member is inserted through opening 18 in circuit board 20 and into the receptacle defined by housing 40. Contact pin portions 32 of terminals 30 project upwardly into the guide member as seen in FIG. 7 while terminating pin portions 34 of the terminals are located outside the guide member as shown in FIG. 6. Board mounted connector 10 now is ready for mating with panel mounted connector 12.

From the foregoing, it can be understood that by providing guide member 60 as a separate component from connector housing 40, the guide member does not interfere with the soldering process with contact pin portions 34 of the terminals being located very near the periphery of opening 18 in circuit board 20. Therefore, valuable real estate on the board is conserved, and the guide member can be provided with a considerable outwardly flared funnel portion 64 for guiding the mating connector into mated condition with the board mounted connector.

Moreover, by configuring the connector 10 to have a bottom wall 42 recessed below the circuit board 18 and pin portions 32 and 34 extending in the upward direction, the connector 10 can be utilized in an application where the given spacing between panels 16 and 20 would not otherwise permit an entire connector to be mounted on the top side 20*b* of the circuit board 20.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly for mounting on a circuit board and for connection to a complementary mating connector through an opening in the circuit board, comprising:

a dielectric housing having means for mounting the housing to one side of the circuit board about the opening therein, said housing including a mating receptacle aligned with the opening in the circuit board, and including an integrally formed leaf spring near the base of the mating receptacle for engagement by the mating connector to absorb mating forces between the connectors;

a plurality of terminals mounted on the housing and including contact portions inside the housing for engaging appropriate terminals of the mating connector and terminating portions for termination to appropriate circuit traces on the circuit board outside the housing; and a guide member mounted on the housing through the opening in the circuit board for guiding the mating connector into connecting position.

2. The electrical connector of claim 1 wherein said housing is mounted to one side of the circuit board, and the guide member is mounted on the housing through the opening from an opposite side of the board.

3. The electrical connector of claim 2 wherein the terminating portions of said terminals comprise pins projecting from said one side of the circuit board through the board for termination to the circuit traces on the opposite side of the board.

4. The electrical connector of claim 3 wherein said housing includes a mating receptacle aligned with the opening in the circuit board, and the contact portions of the terminals comprise pins projecting into the receptacle.

5. The electrical connector of claim 1 wherein said guide member comprises a funnel-like member insertable through the opening in the circuit board.

6. The electrical connector of claim 1 wherein said guide member and said housing include opposing shoulder means for sandwiching the circuit board therebetween.

7. The electrical connector of claim 6, including complementary interengaging latch means between the guide member and the housing to hold the guide member and housing in latched engagement sandwiching the circuit board therebetween.

8. The electrical connector of claim 1, including a flexible latch member on the housing engageable with the circuit board.

9. The electrical connector of claim 8 wherein said guide member is engageable with said latch member when the guide member is mounted on the housing to prevent the latch member from disengagement with the circuit board.

10. The electrical connector of claim 8 wherein said latch member comprises a flexible latch arm engageable with an edge of the opening in the circuit board.

11. An electrical connector for mounting about an opening in a circuit board and for connection to a complementary mating connector through the opening in the circuit board, comprising:

a dielectric housing having side walls extending upwardly from a base wherein said housing includes a mating receptacle aligned with the opening in the circuit board, and including an integrally formed leaf spring near the base of the mating receptacle for engagement by the mating connector to absorb mating forces between the connectors; and a plurality of terminals mounted on the housing and including contact portions inside the housing extending upwardly from the base for engaging appropriate terminals of the mating connector and terminating portions outside of the housing extending upwardly for termination to appropriate circuit traces on the circuit board.

12. The electrical connector of claim 11 wherein the contact portions and the terminating portions of the terminals are connected by lateral portions extending below the base.

* * * * *